US009460873B2

(12) United States Patent
Cernat et al.

(10) Patent No.: US 9,460,873 B2
(45) Date of Patent: Oct. 4, 2016

(54) SWITCHING METHOD AND SWITCHING DEVICE

(71) Applicant: SIEMENS AKTIENGESELLSCHAFT, Munich (DE)

(72) Inventors: Radu-Marian Cernat, Berlin (DE); Martin Krehnke, Berlin (DE); Volker Lehmann, Treuenbrietzen (DE); Friedrich Loebner, Berlin (DE); Andrzej Nowakowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/761,640

(22) PCT Filed: Jan. 7, 2014

(86) PCT No.: PCT/EP2014/050135

§ 371 (c)(1),
(2) Date: Jul. 17, 2015

(87) PCT Pub. No.: WO2014/114484

PCT Pub. Date: Jul. 31, 2014

(65) Prior Publication Data

US 2015/0364280 A1 Dec. 17, 2015

(30) Foreign Application Priority Data

Jan. 22, 2013 (DE) ..... 10 2013 200 914

(51) Int. Cl.
*H01H 3/42* (2006.01)
*H01H 33/02* (2006.01)
(Continued)

(52) U.S. Cl.
CPC ..... *H01H 33/025* (2013.01); *H01H 33/02* (2013.01); *H01H 33/42* (2013.01); *H01H 1/385* (2013.01); *H01H 3/42* (2013.01); *H01H 2033/028* (2013.01)

(58) Field of Classification Search
CPC ..... H01H 25/06; H01H 1/26; H01H 3/46; H01H 9/443; H01H 13/52; H01H 15/102; H01H 15/24; H01H 1/06; H01H 1/20; H01H 1/2016; H01H 1/2075; H01H 1/22; H01H 1/52; H01H 2001/247; H01H 2031/286
See application file for complete search history.

(56) References Cited

U.S. PATENT DOCUMENTS 6,177,643 B1 * 1/2001 Marin ..... H01H 33/245 218/154
2012/0103940 A1 5/2012 Ohda et al.
(Continued)

FOREIGN PATENT DOCUMENTS

DE 19622460 A1 11/1997
EP 1211706 A1 6/2002
(Continued)

*Primary Examiner* — Truc Nguyen
(74) *Attorney, Agent, or Firm* — Laurence Greenberg; Werner Stemer; Ralph Locher

(57) ABSTRACT

A switching device has a first contact side with a first nominal current contact piece and a first electric arc contact piece, and a second contact side with a second electric arc contact piece and a second nominal current contact piece. In order to generate a relative movement between the first and second contact sides, the first electric arc contact piece and the first nominal current contact piece as well as the second electric arc contact piece and the second nominal current contact piece are driven. For switching, the first contact piece is moved by a movement profile and the first nominal current contact piece is moved by a movement profile that differs from the movement profile of the first electric arc contact piece. A movement profile of the second electric arc contact piece and the second nominal current contact piece deviate from each other.

15 Claims, 8 Drawing Sheets

(51) Int. Cl.
*H01H 33/42* (2006.01)
*H01H 1/38* (2006.01)

(56) References Cited

U.S. PATENT DOCUMENTS

2014/0175061 A1* 6/2014 Heiermeier ..... H01H 3/00
218/154
2014/0251957 A1* 9/2014 Cernat ..... H01H 33/7015
218/51
2015/0014131 A1* 1/2015 Gericke ..... H01H 33/245
200/279

FOREIGN PATENT DOCUMENTS

EP 2402969 A1 1/2012
KR 20070008041 A 1/2007
WO 2012155952 A1 11/2012

* cited by examiner

SWITCHING METHOD AND SWITCHING DEVICE

BACKGROUND OF THE INVENTION

Field of the Invention

The invention relates to a switching method for a switching device comprising a first contact side, which is movable relative to a second contact side, wherein the first contact side has a first rated current contact piece and a first arcing contact piece, and the second contact side has a second rated current piece and a second arcing contact piece, wherein, in order to generate a relative movement between the first contact side and the second contact side, the first arcing contact piece and the first rated current contact piece as well as the second arcing contact piece and the second rated current contact piece are driven.

The Korean patent application KR 10 2007-0008041 discloses a switching device which has a first and a second contact side. Both the first and the second contact sides each have an arcing contact piece and a rated current contact piece. A gear is used on one of the contact sides to drive the contact pieces there. The arcing contact piece and the rated current contact piece of the other contact side are likewise arranged movably. In order to control relatively high voltages and currents, it is known to increase the contact-isolation speed or the contact-making speed. Thus, a time interval in which switching arcs can occur is shortened. The desire for higher switching speeds results in the use of more powerful drive devices in order to be able to move the moving masses quickly enough. Greater speeds result in higher forces on the moving parts of the switching device. As a result, the moving parts often need to be strengthened, as a result of which their mass generally increases. Larger moving masses require even greater drive energy to be able to be moved more quickly.

BRIEF SUMMARY OF THE INVENTION

Therefore, an object of the invention consists in specifying a suitable switching method in order to increase, in an alternative form, the switching performance of a switching device.

The object is achieved according to the invention by virtue of the fact that during a switching operation, the first arcing contact piece is moved with a movement profile and the first rated current contact piece is moved with a movement profile, and the movement profiles of the first arcing contact piece and the first rated current contact piece are different than one another, and the second arcing contact piece is moved with a movement profile and a second rated current contact piece is moved with a movement profile, and the movement profiles of the second arcing contact piece and the second rated current contact piece are different than one another.

Switching devices are used for producing or eliminating a current path via which an electric current driven by a potential difference can flow. In order to contact or eliminate the current path, the switching device has contact sides which are movable relative to one another. The contact sides each have an arcing contact piece and a rated current contact piece. The arcing contact pieces and the rated current contact pieces are each provided with contact-making regions. The contact-making regions of the arcing contact pieces are each configured in opposition to one another in order to be able to effect galvanic contact-making. Correspondingly, the contact-making regions of the rated current contact pieces are also formed in opposition to one another.

The first rated current contact piece and the first arcing contact piece of the first contact side are brought into electrical contact currently with one another independently of a switch position of the electrical switching device. Likewise, the second arcing contact piece and the second rated current contact piece of the second contact side are brought into permanent electrical contact independently of a switch position of the electrical switching device. The first arcing contact piece and the first rated current contact piece are movable relative to one another. Likewise, the second arcing contact piece and the second rated current contact piece are movable relative to one another. Furthermore, the first contact side (comprising the first arcing contact piece and the first rated current contact piece) is movable relative to the second contact side (comprising the second arcing contact piece and the second rated current contact piece). In order to be able to perform a switching operation and to generate a relative movement between the contact sides, the first arcing contact piece and the second arcing contact piece as well as the first rated current contact and the second rated current contact piece are driven. In order to generate a movement, one or more drive devices can be used, which convert a form of energy into a movement. The mutually assigned arcing contact pieces and rated current contact pieces of a contact side are moved with movement profiles which differ from one another. A movement profile in this case defines a distance/time behavior of the respective contact piece during a switching operation (for example switch-on operation, switch-off operation). The movement profiles can be fixed, for example, by a mechanism or an electrical controller. In particular, the respective movement profiles of the arcing contact pieces and the rated current contact pieces can be synchronized relative to one another so that specific movements of one contact piece need to be performed before the movement of another contact piece starts/proceeds. Preferably, in the case of a switching operation, the arcing contact pieces should touch one another before the rated current contact pieces, so that switching arcs (prearcing) preferably occur at the arcing contact pieces. In the case of a switch-off operation, first the rated current contact pieces should be isolated, so that an electric current to be interrupted commutates onto the arcing contact pieces. The arcing contact pieces are then isolated from one another. A switching arc (switch-off arc) is thus preferably guided between the arcing contact pieces. The arcing contact pieces protect the rated current contact pieces from erosion.

Depending on requirements, the time of contact-making of the arcing contact pieces/the rated current contact pieces or the time of isolation of the rated current contact pieces/the arcing contact pieces can be fixed by a variation of the individual movement profiles. Thus, for example, the time delay between the isolation and/or contact-making of the arcing contact pieces and the rated current contact pieces can be varied by virtue of a configuration of the movement profiles. In addition to a temporal variation, the location of contact-making can also be changed by virtue of a change to the movement profiles. It is thus possible, for example, to perform contact-making of the arcing contact pieces closer to one contact side, based on a switching path, and to perform contact-making of the rated current contact pieces closer to the other contact-making side, or vice versa. The same applies to a switch-off operation. Despite different movement profiles of the arcing contact pieces and the rated current contact pieces, provision can be made for an identical movement of an arcing contact piece and a rated current contact piece of a contact side to take place temporarily. For example, during a time window of a switching operation, an arcing contact piece and a rated current contact piece can be moved in such a way that the arcing contact piece and the rated current contact piece remain at rest relative to one another, but are in motion with respect to a common reference.

Furthermore, it can advantageously be provided that in the case of a switch-on operation, first the rated current contact pieces move closer to one another while the arcing contact pieces remain in a field shadow of the respectively assigned rated current contact piece.

A switch-on operation is used for forming a closed current path for conducting an electric current. In the case of switching devices which act as power switching device, a current-loaded switching operation can take place both during a switch-on operation and during a switch-off operation. The two contact sides can have electrical potentials which differ prior to and during a switch-on operation. Correspondingly, an electrical field can already be present between the contact sides prior to the onset of a switch-on operation. As the distance between the contact sides is reduced, the electrical field strength increases. Despite leading contact-making of the arcing contact pieces in the case of a switch-on operation, first the rated current contact pieces move closer to one another, wherein the arcing contact pieces remain in the field shadow of the respective rated current contact piece. At least the contact-making regions of the arcing contact pieces should remain in the respective field shadow. It is thus possible, for example, for first only the first rated current contact piece and the second rated current contact piece to be moved while the arcing contact pieces remain at rest still. The rated current contact pieces should have a more favorable shape for homogenization of an electrical field than the arcing contact pieces. The field-influencing effect of the rated current contact pieces is used to neutralize a possibly field-weakening effect of the arcing contact pieces. Owing to the use of the rated current contact pieces for shielding the arcing contact pieces, additional shielding elements can be dispensed with.

Furthermore, it can advantageously be provided that the arcing contact pieces are already brought closer to one another while remaining in the field shadow.

The time period in which the rated current contact pieces move closer to one another can be used to prepare the switching device for the emergence of the arcing contact pieces from the field shadow. At least one of the arcing contact pieces can be moved along synchronously with a rated current contact piece, for example, so that the arcing contact pieces move closer to one another and finally leave the field shadow of the rated current contact piece. However, it can also be provided that an arcing contact piece is moved (at least temporarily) at a greater speed than the associated rated current contact piece in order to move closer to the other arcing contact piece. The two contact pieces can in this case move identically or else have movement profiles which differ from one another. Independently of the manner by which the arcing contact pieces move closer to one another, the two arcing contact pieces of the contact sides should preferably be accelerated, lying within the field shadow of the rated current contact pieces. Thus, precise, quick emergence from the field shadow of the respective rated current contact piece is possible. The arcing contact pieces weaken the electrical field located between the rated current contact pieces, so that excess field strengths occur at the arcing contact pieces and prearcing preferably occurs between the arcing contact pieces.

Furthermore, it can advantageously be provided that when a defined critical distance between the rated current contact pieces is reached, at least one of the arcing contact pieces, in particular both of the arcing contact pieces emerge from the field shadow of the respectively assigned rated current contact piece.

A definition of the critical distance is performed depending on the contact geometry of the electrical switching device, the insulating medium used and the electrical potential difference present. A critical field strength which can expect the occurrence of a switch-on arc between the rated current contact pieces is associated with the critical distance. Until the critical distance is reached, the more favorable shape of the rated current contacts can be used to move the contact sides initially closer to one another. Only at this time is the protective effect of the arcing contact pieces required. Premature field weakening owing to unshielded arcing contact pieces is thus avoided. The protective effect of the arcing contact pieces starts with the emergence from the field shadow. In this case, at least the contact-making regions of the arcing contact pieces should leave the respective field shadow. By virtue of the rated current contact pieces, an electrical field located between the contact sides can be homogenized during an extended time interval of a switch-on operation. Only at a comparatively late time is the onset of prearcing at the arcing contact pieces forced by targeted weakening of the electrical field.

Furthermore, it can advantageously be provided that in a switch-off operation, first the rated current contact pieces are isolated and then isolation of the arcing contact pieces takes place and isolation of the arcing contact pieces from one another takes place at a relative speed which has approximately its maximum during a switch-off operation.

When a switching device is configured as a power switching device, an electric current flowing during the interruption of the current path to be switched can be interrupted. In the case of leading opening of the rated current contact pieces, an electric current to be interrupted commutates onto the arcing contact pieces, which are initially still in galvanic contact with one another. In the case of lagging opening of the arcing contact pieces, the electric current can continue to flow within a fluid insulating medium surrounding the arcing contact pieces initially in the form of a striking switching arc. In order to counteract striking of a switching arc, the relative speed of the arcing contact pieces should have approximately its maximum during a switch-off operation at the time of isolation of the arcing contact pieces. Owing to high contact isolation speeds, the time windows in which favorable conditions for striking of a switch-off arc are present are shortened. Correspondingly, the probability of the occurrence of a switch-off arc is reduced. Furthermore, owing to a high contact isolation speed, the roots for a switching arc are removed from one another, so that a possibly struck switching arc is extended and can be quenched more easily. Since the individual contact pieces, in particular also the arcing contact pieces are moved with different movement profiles, a resultant relative speed of the contact isolation of the arcing contact pieces is set. By adapting the movement profiles on both sides of the switching path (on each of the contact sides), the resultant relative speed can be set. For example, in the case of a switch-off operation, the arcing contact pieces can first be moved relatively slowly towards one another in order to prepare for isolation of the arcing contact pieces and to allow initially the rated current contact pieces to be isolated from one another in order to then be accelerated in order to achieve a high contact isolation speed.

In this case, it can furthermore be provided that once a defined critical distance between the rated current contact pieces has been reached, at least one of the arcing contact pieces, in particular both of the arcing contact pieces enter the field shadow of the respectively assigned rated current contact piece.

A return of the arcing contact pieces into the field shadows of the associated rated current contact pieces assists with strengthening of the switching path at an earlier time. Thus, there is a possibility of being able to use the switching device even in relatively high voltage ranges. The arcing contact pieces are dielectrically neutralized after in particular complete entry into the field shadows, with the result that the distribution of the electrical field is influenced by the rated current contact pieces. Until the critical distance is reached, field intensity peaks preferably occur at the arcing contact pieces. When a critical distance between the rated current contact pieces is reached, the arcing contact pieces are brought into the field shadow of the rated current contact pieces since the distance between the rated current contact pieces can now be estimated as being dielectrically stable. The arcing contact pieces, which would weaken the dielectric stability between the rated current contact pieces, are brought into field shadows. In particular, the contact-making regions of the arcing contact piece(s) should enter the field shadow.

Furthermore, it can advantageously be provided that the first arcing contact piece is moved relative to an insulating nozzle, which is connected, in particular in angularly rigid fashion, to the first rated current contact piece, during a switching operation.

An insulating nozzle can interact with the contact pieces, in particular with the arcing contact pieces of the switching device. Thus, the insulating nozzle can have a nozzle channel within which a switching arc is guided. For this purpose, the arcing contact pieces (in particular the contact-making regions thereof) should be at least partially and/or at least temporarily surrounded by the insulating nozzle. The insulating nozzle can be formed in one or more parts. Preferably, the insulating nozzle should be a body of revolution, which has a nozzle channel which extends in the direction of the axis of rotation, in particular centrally. The first arcing contact piece can have, for example, a socket-shaped contact-making region, wherein the socket represents an opening of a channel of the first arcing contact piece. The first arcing contact piece should preferably be in the form of a tubular contact piece. The first arcing contact piece should be arranged with its opening in front of an opening of the nozzle channel. The contact-making region of the first arcing contact piece should be surrounded by the insulating nozzle. In the event of a relative movement of the first arcing contact piece with respect to the insulating nozzle arrangement, the distance between the openings should vary. Thus, a gap with a variable width is formed between the openings, said gap being filled with an insulating fluid. The opening of the nozzle channel can open out into a cutout in the insulating nozzle. The first arcing contact piece can protrude, in particular in form-complementary fashion, into this cutout. As a result of a relative movement, the entry depth of the first arcing contact piece into the cutout can vary. The insulating nozzle can be supported on the first contact side. In particular, the insulating nozzle should be connected in angularly rated fashion to the first rated current contact piece and should be movable therewith. The first contact side can be provided with a heating volume for buffer-storing switching gas. The insulating nozzle can at least partially limit this heating volume. The heating volume can be substantially hollow-cylindrical, for example, and the first arcing contact piece, which is movable relative to the heating volume, can pass through said heating volume. The heating volume can be delimited on the outer lateral surface side by the first rated current contact piece, for example.

Furthermore, it can advantageously be provided that the first arcing contact piece is moved towards the insulating nozzle during a switch-on operation.

As a distance between the first arcing contact piece and an opening of the nozzle channel is reduced, a gap between the arcing contact piece and the insulating nozzle can be reduced in size. In particular the fact of the openings moving closer to one another results additionally in an increase in the contact-making speed during a switch-on operation. Furthermore, the switching device is thus already prepared for a switch-off operation with a switch-on operation.

It can further advantageously be provided that the first arcing contact piece is removed from the insulating nozzle during a switch-off operation.

As the first arcing contact piece is removed from the insulating nozzle, the gap between the openings is enlarged. Furthermore, the distance which needs to be bridged by a switching arc is increased. Correspondingly, the switching arc can be quenched more easily. In particular at a time after quenching of the switching arc and therefore of final interruption of a current flow, an electrical field occurs between the contact sides owing to potential differences. The insulating nozzle comprises electrically insulating material, for example an organic plastic such as PTFE. An increased quantity of electrically insulating fluid can be introduced into the gap as the spacing increases at the transition between the solid insulation of the insulating nozzle and a fluid insulation around the first arcing contact piece. Thus, a transition between fluid and solid insulation can be made more dielectrically stable. As a result, an improved dielectric strength of the switching path in the switched-off state is also provided.

A further object consists in specifying a suitable switching device for implementing the method.

The object is achieved by a switching device comprising a first contact side, which is movable relative to a second contact side, wherein the first contact side has a first rated current contact piece and a first arcing contact piece, and the second contact side has a second rated current contact piece and a second arcing contact piece, wherein, in order to generate a relative movement between the first contact side and the second contact side, the first arcing contact piece and the first rated current contact piece as well as the second arcing contact piece and the second rated current contact piece are driven, wherein a first kinematic chain has a drive means and a first output-drive means and a second output-drive means, wherein the first output-drive means couples in a first movement profile onto the first rated current contact piece, and a second output-drive means couples in a different second movement profile onto the first arcing contact piece, and a second kinematic chain has a drive means and a first output-drive means and a second output-drive means, wherein the first output-drive means couples in a first movement profile onto the second rated current contact piece, and the second output-drive means couples in a different second movement profile onto the second arcing contact piece.

A kinematic chain is used for transmitting a movement between two points. A kinematic chain has at least one machine component, by means of which movements are transmitted. A kinematic chain can have, for example, a connecting rod, which transmits movement. Furthermore, kinematic chains can have a plurality of operatively connected machine components, such as, for example, shafts, levers, gearwheels, toothed racks, cranks, transmission elements, etc. A movement transmitted by a kinematic chain can be converted, coupled out, distributed etc. within the kinematic chain. A kinematic chain can act as a gear which has at least one input side and at least one output side. On the input side, the gear can have a drive means, and can have an output-drive means on the output side.

An output-drive means consumes drive energy for moving one or more contact pieces, and an output-drive means outputs output-drive energy directly or indirectly to one or more contact pieces. A wide variety of machine components can be used as drive means and/or output-drive means, for example, such as shafts, levers, gearwheels, cranks, bolts, rods, etc. The drive side and the output-drive side can be the input and output side of the kinematic chain, for example. The kinematic chain can convert a movement fed in on the drive side and output this movement on the output-drive side. However, it can also be provided that at least approximately identical movements are present on the drive side and on the output-drive side. The kinematic chain can be a gear. By using a drive means and a second output-drive means, a movement can be fed in and different movement profiles can be output. It is thus possible, for example, to use a common drive device, which couples in a movement onto the drive means of a kinematic chain or a plurality of kinematic chains, wherein different movement profiles are coupled out at the output-drive means or are coupled in onto the respective switching contact piece. When using a kinematic chain, the possibility is furthermore provided of outputting a plurality of movement profiles in synchronism with one another on the output-drive side.

Furthermore, it can advantageously be provided that the first or second output-drive means of the first kinematic chain is connected to a drive means of the second kinematic chain.

By virtue of an output-drive means of a first kinematic chain being coupled to a drive means of the second kinematic chain, the output-drive movements of both kinematic chains are synchronized with one another. Furthermore, a common drive device can be used, whose output movement can be converted into four different movement profiles of the arcing contact pieces and rated current contact pieces.

In the event of a fault, this has the advantage that the entire switching device is not switchable. Individual movements or sub functions of the switching device are thus prevented.

Furthermore, it can advantageously be provided that the first or second output-drive means is connected to the second kinematic chain via an electrically insulating transmission element.

A displacement of electrical potentials is counteracted via an electrically insulating transmission element. It is thus possible, for example, to arrange component parts of the first and second kinematic chains on different contact sides with electrical potentials which are different from one another. Insulating sleeves, insulating bearings, insulating levers, etc. can be used as electrically insulating transmission elements. Advantageously, the electrically insulating component should delimit an electrically insulated section in the region of a switching path of the switching device, so that transmission elements located on both sides of the switching path of the kinematic chains are connected to one another, but short-circuit current paths are interrupted by the electrically insulating element. An insulating nozzle can be used as transmission element, for example. The insulating nozzle bridges a switching path between the contact sides, for example. Thus, the insulating nozzle can be used for directing and guiding a switching arc. In addition, the insulating nozzle can be used for transmitting a drive movement as part of a kinematic chain.

An exemplary embodiment of the invention will be shown schematically below in a drawing and described in the text which follows.

DESCRIPTION OF THE INVENTION

Figure 1:
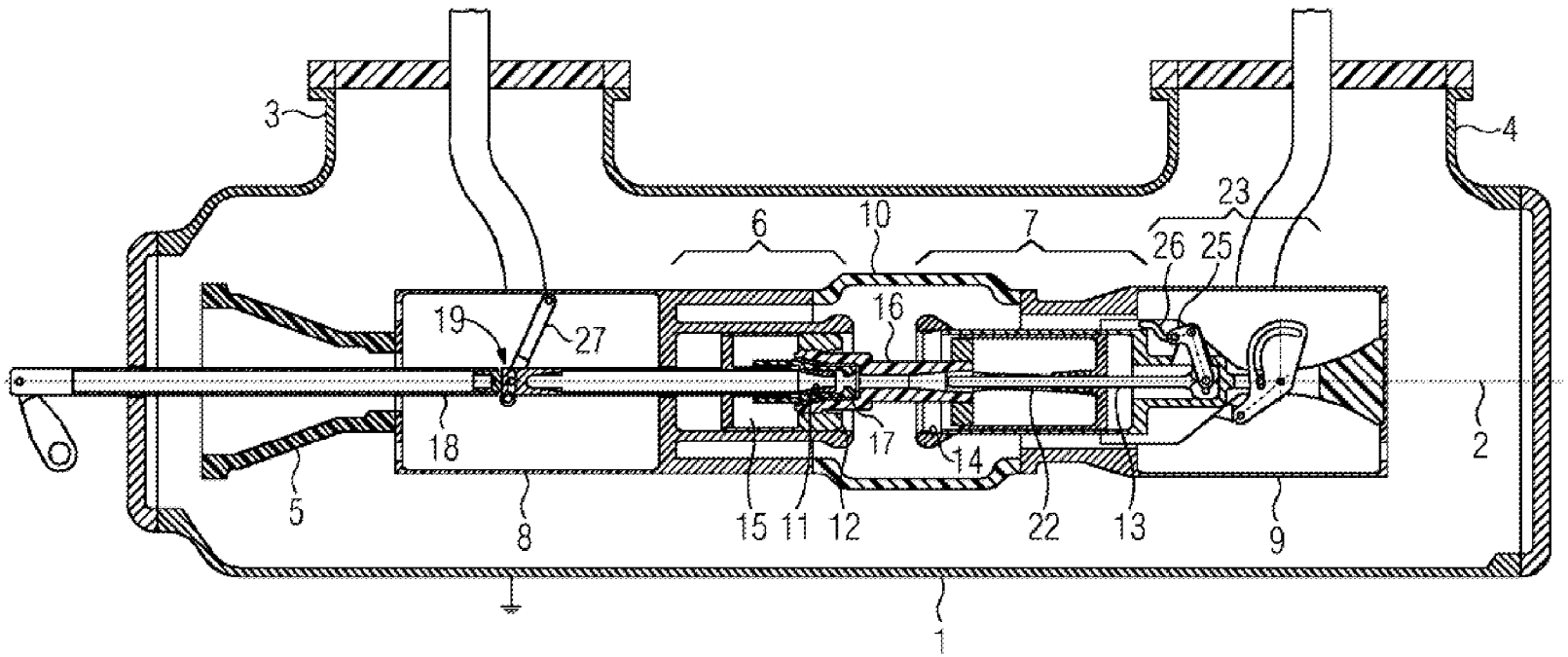
FIG. 1 shows a section through a switching device.

FIG. 1 shows a section through a switching device. The switching device has an encapsulating housing 1. The encapsulating housing 1 has a substantially tubular metallic basic body. The basic body conducts ground potential. The encapsulating housing 1 has a longitudinal axis 2. The encapsulating housing 1 is filled with an electrically insulating fluid. Preferably, the use of an insulating gas under excess pressure such as sulfur hexafluoride, nitrogen, carbon dioxide or the like is provided. End-side openings in the encapsulating housing 1 are each sealed in fluid-tight fashion by a cover. On the lateral surface side, a first flange connection piece 3 and a second flange connection piece 4 are arranged on the encapsulating housing 1. The first and second flange connection pieces 3, 4 are used for introducing, in electrically insulated fashion, phase conductors of a current path to be switched. In order to prevent volatilization of an electrically insulating fluid out of the interior of the encapsulating housing 1, disk insulators engaging around the phase conductors and sealing the flange connection pieces 3, 4 are connected to the flange connection pieces 3, 4. Alternatively, outdoor bushings can be arranged on the flange connection pieces 3, 4, for example, in order to incorporate the switching device in an overhead line system, for example.

An interrupter unit of the electrical switching device is arranged in the interior of the encapsulating housing 1. The interrupter unit extends centrally in the encapsulating housing 1 along the longitudinal axis 2. The interrupter unit is surrounded by the electrically insulating fluid and said electrically insulating fluid flushes through said interrupter unit. In order for the interrupter unit to be supported in electrically insulated fashion on the encapsulating housing 1, post insulators are used, of which a post insulator 5 is illustrated by way of example. The interrupter unit has a first contact side 6 and a second contact side 7. The two contact sides 6, 7 are mounted movably relative to one another. The first contact side 6 is mounted in sliding fashion in a first mounting element 8. The second contact side 7 is mounted in sliding fashion in a second mounting element 9. The two mounting elements 8, 9 are electrically conductive and have been brought into contact with in each case one of the phase conductors passed through the flange connection pieces 3, 4. The two mounting elements 8, 9 are arranged fixed in position with respect to one another and fixed in position with respect to the encapsulating housing 1. The two mounting elements 8, 9 are in the form of substantially rotationally symmetrical hollow bodies, whose axes of rotation are oriented coaxially with respect to the longitudinal axis 2. End sides of the mounting elements 8, 9 are arranged facing one another and spaced apart from one another. The end sides of the mounting elements 8, 9 which face one another are connected to one another via an insulating body 10, with the result that the two mounting elements 8, 9, with insertion of the insulating body 10, form a chassis of the interrupter unit. In this case, the insulating body 10 is in the form of a hollow body which is widened in bulbous fashion and which accommodates, in its interior, a switching path between the first contact side 6 and the second contact side 7. For example, cage-like bar constructions or the like can also be used as insulating body 10.

The first contact side 6 and the second contact side 7 rest in sliding fashion in each case one socket of the first or second mounting element 8, 9 and are in electrically conductive contact with the mounting elements 8, 9. Thus, permanent contact between the two contact sides 6, 7 and in each case one of the phase conductors passed through the flange connection pieces 3, 4 is provided via the mounting element 8, 9.

The first contact side 6 has a first arcing contact piece 11. The first contact side 6 has a first rated current contact piece 12. The first arcing contact piece 11 is tubular and is provided at the end with a socket-shaped contact-making region. A channel for dissipating switching gas is arranged in the interior of said arcing contact piece. The socket-shaped contact-making region acts as opening of the channel of the first arcing contact piece 11. The first arcing contact piece 11 is oriented coaxially with respect to the longitudinal axis 2 and is movable along the longitudinal axis 2. On the outer lateral surface side, the first arcing contact piece 11 is surrounded by the tubular first rated current contact piece 12.

The first rated current contact piece 12 is displaceable relative to the first arcing contact piece 11 along the longitudinal axis 2. A second arcing contact piece 13 is arranged on the second contact side 7. The second arcing contact piece 13 is in the form of a bolt and is mounted displaceably coaxially with respect to the longitudinal axis 2. The second arcing contact piece 13 is surrounded by a substantially tubular second rated current contact piece 14. The second rated current contact piece 14 and the second arcing contact piece 13 are movable relative to one another and along the longitudinal axis 2.

A heating volume 15 is arranged in a hollow-cylindrical space between the first rated current contact piece 12 and the first arcing contact piece 11. The heating volume 15 is delimited on its side facing the second contact side 7 by an insulating nozzle 16. The insulating nozzle 16 is connected in angularly rigid fashion to the first rated current contact piece 12, with the result that movements of the first rated current contact piece 12 are performed together with the insulating nozzle 16. The first arcing contact piece 11 is movable relative to the first rated current contact piece 12 and the insulating nozzle 16. The insulating nozzle 16 has a main section and an auxiliary section, wherein the main section and the auxiliary section are spaced apart from one another via a ring channel 17, which connects a nozzle channel to the heating volume 15. The ring channel 17 opens out into the nozzle channel from radial directions. The nozzle channel is extended in the direction of the longitudinal axis 2 centrally through the rotationally symmetrical insulating nozzle 16. The end-side openings of the nozzle channel each face one of the arcing contact pieces 11, 14. The opening of the nozzle channel which faces the first arcing contact piece 11 opens out into a cutout of the insulating nozzle 16. In this case, the first arcing contact piece 11 enters the cutout so that the socket-shaped contact-making region of the first arcing contact piece 11, as opening, is opposite the facing end-side opening of the insulating nozzle 16. A gap with a variable dimension is formed between the mutually facing openings of the first arcing contact piece 11 and the nozzle channel. The extent of the gap varies depending on the switching state of the switching device. The first arcing contact piece 11 is inserted in form-complementary fashion into the cutout (in the insulating nozzle 16) into which the nozzle channel opens out. The variable gap is encompassed at the circumference by the insulating nozzle 16.

Figure 7:
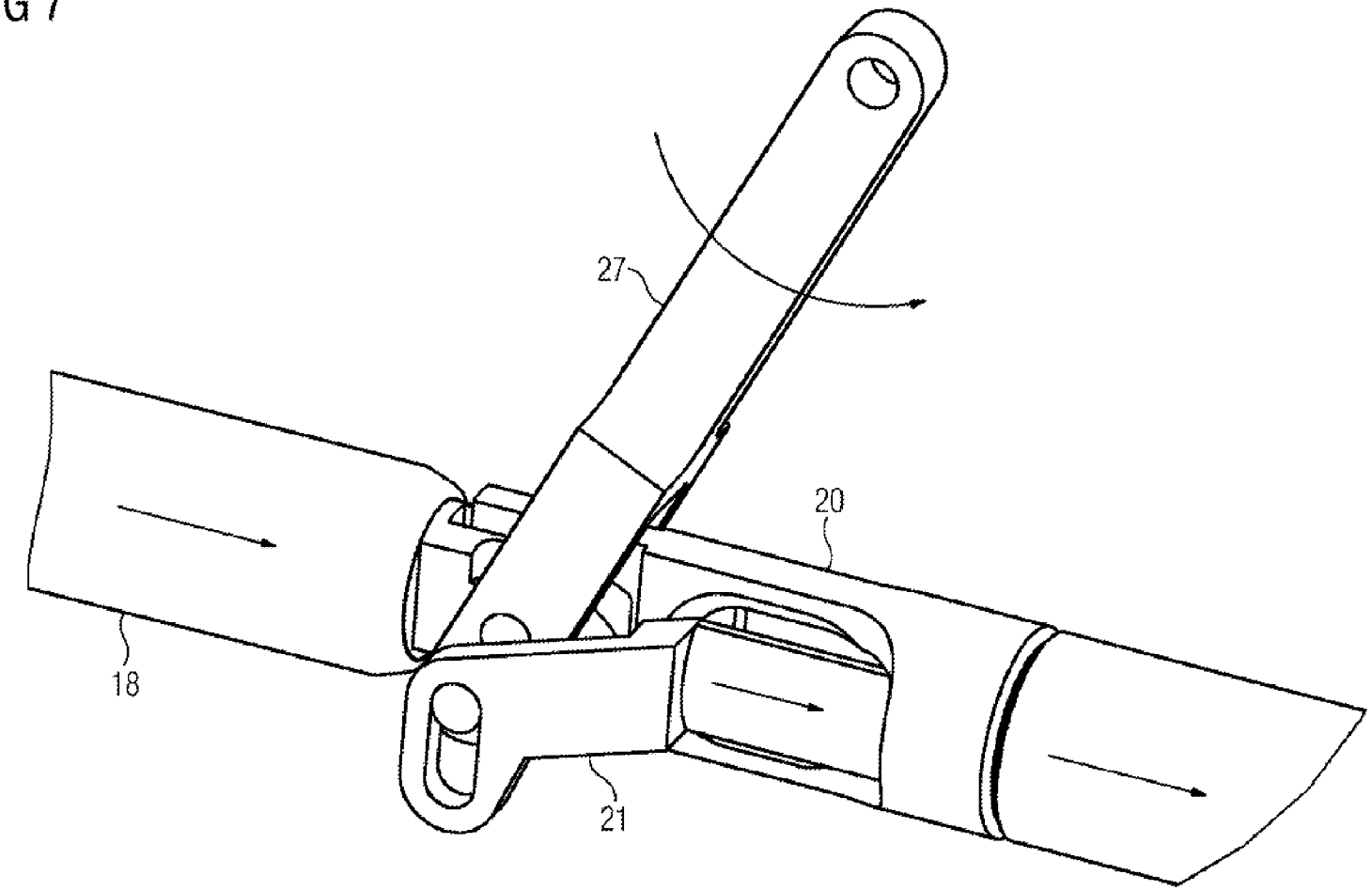
FIG. 7 shows a first variant embodiment of a first reduction gear.

A drive device is arranged outside the area surrounded by the encapsulating housing 1. A movement output by the drive device (not illustrated in FIG. 1) is transmitted via a drive rod 18 in fluid-tight fashion through a wall of the encapsulating housing 1 to the inner interrupter unit. In this case, the drive rod 18 is designed to perform a substantially linear movement. The drive rod 18 rests with its rod axis on the longitudinal axis 2 of the encapsulating housing 1 and is movable in the direction of the longitudinal axis 2. The drive rod 18 is a drive means of a first kinematic chain. The first kinematic chain has a first reduction gear 19. The first reduction gear 19 of the first kinematic chain has a first output-drive means 20 and a second output-drive means 21. The first output-drive means 20 is coupled to the first rated current contact piece 12. The second output-drive means 21 is coupled to the first arcing contact piece 11. The first output-drive means 20 and the second output-drive means 21 couple in movement profiles which are different from one another onto the first rated current contact piece 12 and onto the first arcing contact piece 11. The mode of operation and design of the first reduction gear 19 in a first variant embodiment are shown in FIG. 7 and are described in more detail in the description relating to the figure.

The insulating nozzle 16 is connected in angularly rigid fashion to the first rated current contact piece 12. The insulating nozzle 16 spans the switching path located between the contact sides 6, 7 in electrically insulating fashion. The insulating nozzle 16 protrudes into the second rated current contact piece 14 and bears against the second rated current contact piece 14. The second arcing contact piece 13 can enter the nozzle channel of the insulating nozzle 16. During a switching movement, the insulating nozzle 16 enters the second rated current contact piece 14. At the end remote from the first rated current contact piece 12, a connecting rod 22 is fastened to the insulating nozzle 16 in rotationally movable fashion. The connecting rod 22/the insulating nozzle 16 forms a second drive means of a second kinematic chain, which has a second reduction gear 23. The second reduction gear 23 has a crank arm 24 positioned fixed in position on the second mounting element 9. The crank arm 24 is connected to the connecting rod 22 so that a linear movement of the insulating nozzle 16 can be converted into a rotary movement of the crank arm 24. The crank arm 23 furthermore has a slotted link, into which a sensing bolt engages. The sensing bolt is oriented transversely with respect to the longitudinal axis 2 and crosses the longitudinal axis 2. The sensing bolt is connected in angularly rigid fashion to the second rated current contact piece 14 and is displaceable together with said rated current contact piece along a longitudinal axis 2. The sensing bolt acts as first output-drive means of the second kinematic chain. By virtue of a movement of the crank arm 23 together with the slotted link, a rotary movement is converted into a linear movement and coupled in onto the second rated current contact piece 14. The driving linear movement of the drive means (connecting rod 22/insulating nozzle 16) in this case has an opposite sense of direction to the movement of the second rated current contact piece 14. By virtue of the shape of the slotted link, a specific movement profile is further impressed on the second rated current contact piece 14.

The second arcing contact piece 13 is mounted displaceably on the second rated current contact piece 14. The second arcing contact piece 13 has a hammer head at its end remote from the contact-making region, which hammer head is mounted in linearly displaceably sliding fashion in a cutout. Furthermore, a fulcrum of a two-armed lever 25 is arranged on the second rated current contact piece 14, with one lever arm of said two-armed lever being guided in sliding fashion in a slot in the hammer head of the second arcing contact piece 13. The two-armed lever 25 engages with its other lever arm in a slotted-link passage 26 which is fixed in position. The slotted-link passage 26 which is fixed in position is connected in angularly rigid fashion to the second mounting element 9. Over the course of a switching movement, the second rated current contact piece 13 is moved along the longitudinal axis 2. Correspondingly, the fulcrum of the two-armed lever 25 is also moved along. The two-armed lever 25 sweeps the slotted-link passage 26 which is fixed in position and is pivoted as a result of an advancement of a movement of the second rated current contact piece 14 dependent on the profile of the slotted-link passage 26 which is fixed in position. This pivoting movement is transmitted via the slot in the hammer head of the second arcing contact piece 13 onto the arcing contact piece 13. Depending on the profile of the slotted-link passage 26 which is fixed in position, a movement of the second arcing contact piece 13 takes place with a movement profile which differs from the movement profile of the second rated current contact piece 14. The two-armed lever 25 acts as second output-drive means of the second kinematic chain. In this case, the first output-drive means 20 of the first kinematic chain is connected to the drive means of the second kinematic chain, wherein the insulating nozzle 16 acts as electrically insulating transmission element.

Figure 2:
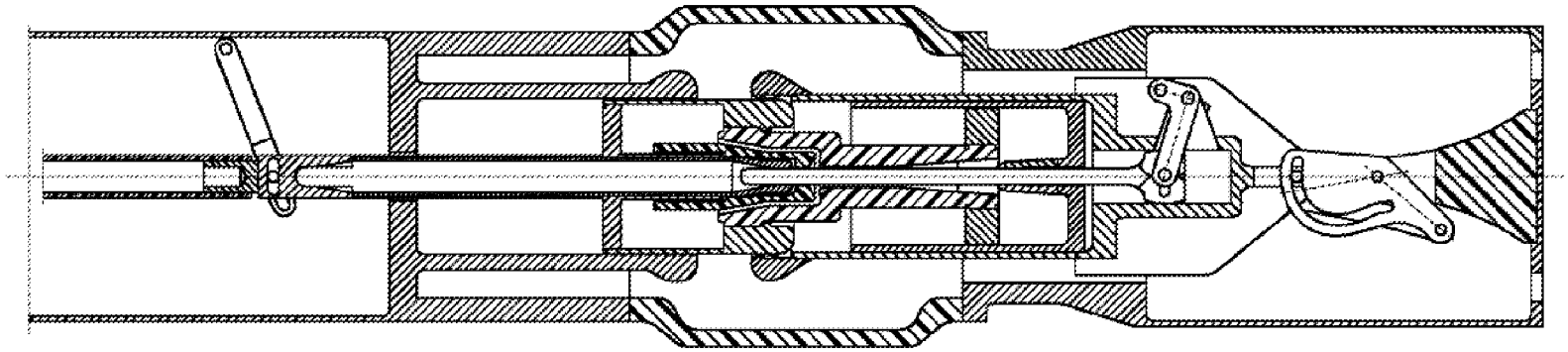
FIG. 2 shows the switching device known from FIG. 1 in the switch-on state.
Figure 3:
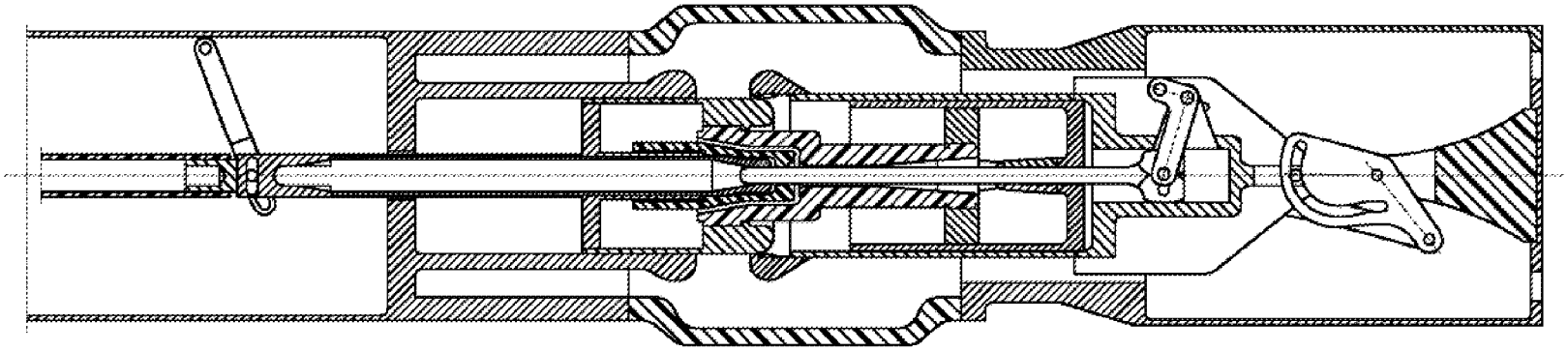
FIGS. 3 to 6 show a switching sequence for transferring the switching device from a switch-on state (FIG. 2) to a switch-off state (FIG. 6)
Figure 4:
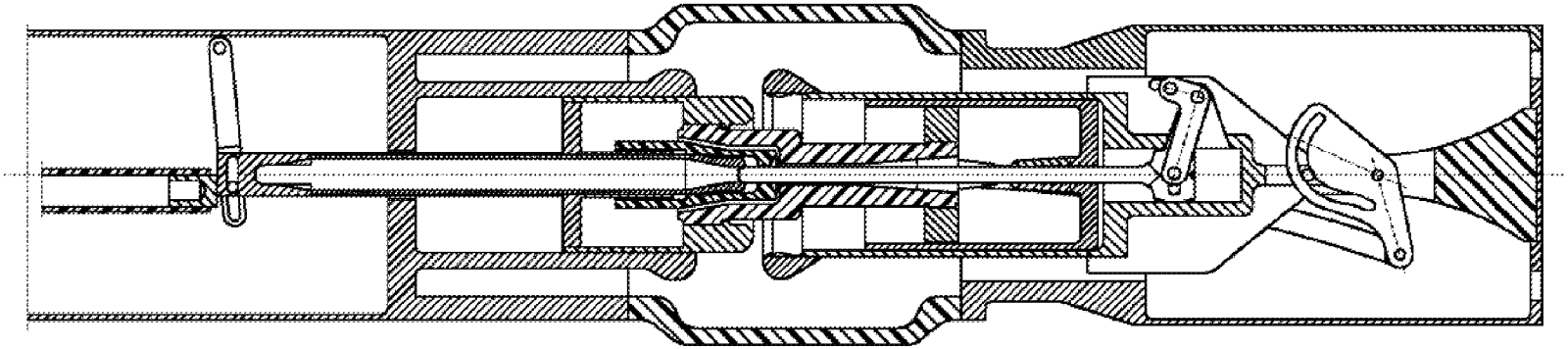
Figure 6:
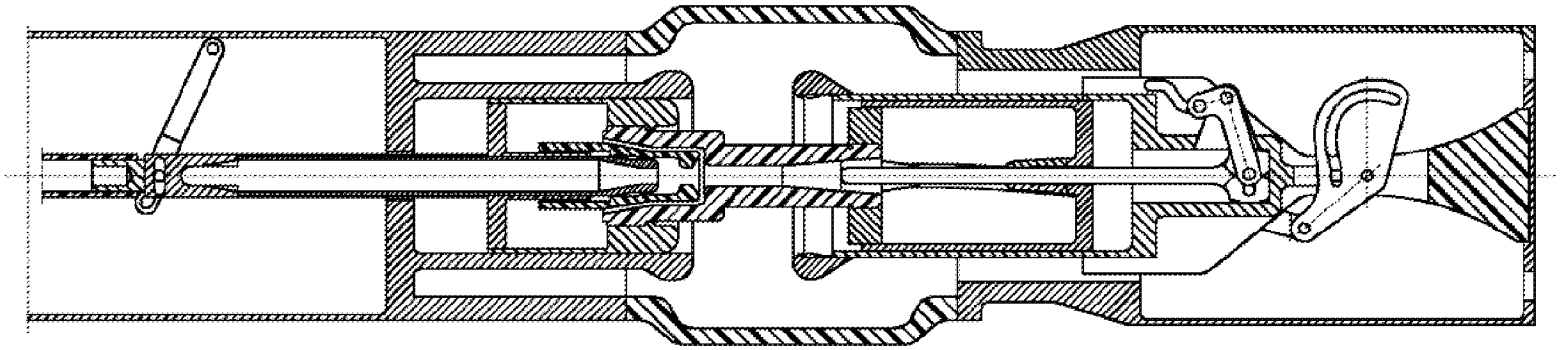

A movement sequence of an electrical switching device from its switch-on state (FIG. 2) into its switch-off state (FIG. 6) will be described below. In the switch-on state, the rated current contact pieces 12, 14 and the arcing contact pieces 11, 13 are in engagement with one another. The first arcing contact piece 11 has entered a cutout in the insulating nozzle 16 and has a minimum distance from the facing opening of the nozzle channel. First, a movement is coupled in onto the drive rod 18. This movement is passed on virtually directly to the first rated current contact piece 12. The first rated current contact piece 12 is removed from the second rated current contact piece 14. At the same time, a movement is applied to the first arcing contact piece 11, which is removed from the second arcing contact piece 12. The first arcing contact piece 11 is also removed from the insulating nozzle 16, with the result that the gap with respect to the opening of the nozzle channel is enlarged. Owing to the mode of operation of the first reduction gear 19, the first arcing contact piece 11 moves more quickly than the first rated current contact piece 12 (cf. FIG. 7 and associated description). A movement of the first kinematic chain is transmitted onto the crank arm 24 via the insulating nozzle 16 and the connecting rod 22. The slotted-link of the crank arm 24 has such a shape (concentric circular path around the crank fulcrum) that initially no movement can be transmitted onto the second rated current contact piece 14 and the second arcing contact piece 13 (FIG. 2). At the time of the isolation of the rated current contact pieces 12, 14 (FIG. 3), a switch-off current commutates onto the arcing contact pieces 11, 13. A movement of the second rated current contact piece 14 begins. As a result, the second arcing contact piece 13 is also moved initially at the same speed as the second rated current contact piece 14. After isolation of the rated current contact pieces 12, 14, isolation of the arcing contact pieces 11, 13 takes place (FIG. 4). An additional acceleration of the arcing contact pieces 11, 13 is impressed on the arcing contact pieces 11, 13 in each case by the first and second reduction gears 15, 23. The arcing contact pieces 11, 13 each move more quickly than the assigned rated current contact pieces 12, 14. The relative speed between the arcing contact pieces 11, 13 should have reached its maximum at the time of contact isolation. The arcing contact pieces 11, 13 can, after isolation, guide a switching arc, which preferably burns within the nozzle channel. Switching gas heated by the switching arc can be dissipated out of the nozzle channel in the direction of the opening of the first arcing contact piece 11 and be conducted on in the channel of the first arcing contact piece 11. Furthermore, hot switching gas can be buffer-stored and compressed in the heating volume 15.

Figure 5:
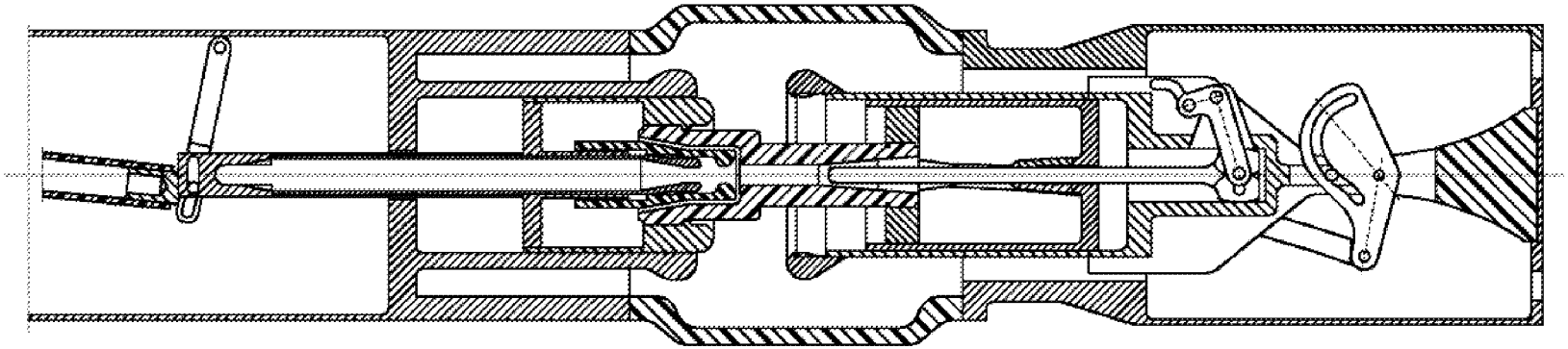

As the switch-off movement progresses, the distance between the openings of the nozzle channel and the channel of the first arcing contact piece 11 increases. Furthermore, the arcing contact pieces 11, 13 are moved back into the field shadow of the respectively assigned weighted current contact pieces 12, 14. As the switching movement continues, ever greater proportions of the arcing contact pieces 11, 13 are in the respective field shadow. As the arcing contact pieces 11, 13 (in particular the contact-making regions) completely enter the respective field shadows, a critical distance between the rated current contact pieces 12, 14 is exceeded. As the critical distance is reached, a sufficient dielectric strength is present between the two contact sides 2, 3 (FIG. 5).

Once a switching arc has been quenched, the compressed switching gas flows out of the heating volume into the nozzle channel and removes remaining residues from said nozzle channel. The arcing contact pieces 11, 13 and the rated current contact pieces 12, 14 are moved further away from one another. Thus, a safe end position is reached in which, given stable dielectric conditions between the contact sides 6, 7, different electrical potentials are isolated from one another. In the switch-off position (FIG. 6), the gap between the opening of the channel of the first arcing contact piece 11 and the assigned opening of the nozzle channel has its greatest axial extent.

During a switch-on operation from the switch-off position (FIG. 6) into the switch-on position (FIG. 2), a reversed movement sequence takes place.

FIG. 7 shows the first reduction gear 19 of a first variant embodiment in detail.

The first reduction gear 19 has a single-armed lever 27. The single-armed lever 27 is mounted pivotably fixed in position on the first mounting element 8. The drive rod 18 is connected in rotationally movable fashion to the single-armed lever 27 by means of a bolt. The bolt also passes through a slot in the first output-drive means 20. The first output-drive means 20 is substantially tubular, wherein the first rated current contact piece 12 and/or the insulating nozzle 16 are connected to the output-drive means 20. An excess excursion occurring during pivoting of the single-armed lever 27 can be compensated for via the slot of the first output-drive means 20, while the rotationally movable connection between the drive rod 18 and the single-armed lever 27 via the bolt is compensated for by elastic deflection of the drive rod 18. The second output-drive means 21 is guided displaceably in the interior of the tubular first output-drive means 20. A bend in the second output-drive means 21 protrudes out of the interior of the first output-drive means 20 via an opening located in the first output-drive means 20 on the lateral surface side. The bend in the second output-drive means 21 is connected to the single-armed lever. For this purpose, the bend has a slot, in which a bolt of the single-armed lever 27 engages. In this case, the distance between the bolt and the fulcrum of the single-armed lever 27 is greater than the distance between the bolt and the fulcrum of the single-armed lever 27. Correspondingly, the second output-drive means 21 is moved more quickly than the first output-drive means 20. The two output-drive means 20, 21 thus couple movement profiles which differ from one another onto the first rated current contact piece 12 and the first arcing contact piece 11. In the configuration provided in accordance with FIG. 7, the movements of different movement profiles of the two output-drive means 20, 21 begin and end at the same time.

Figure 8:
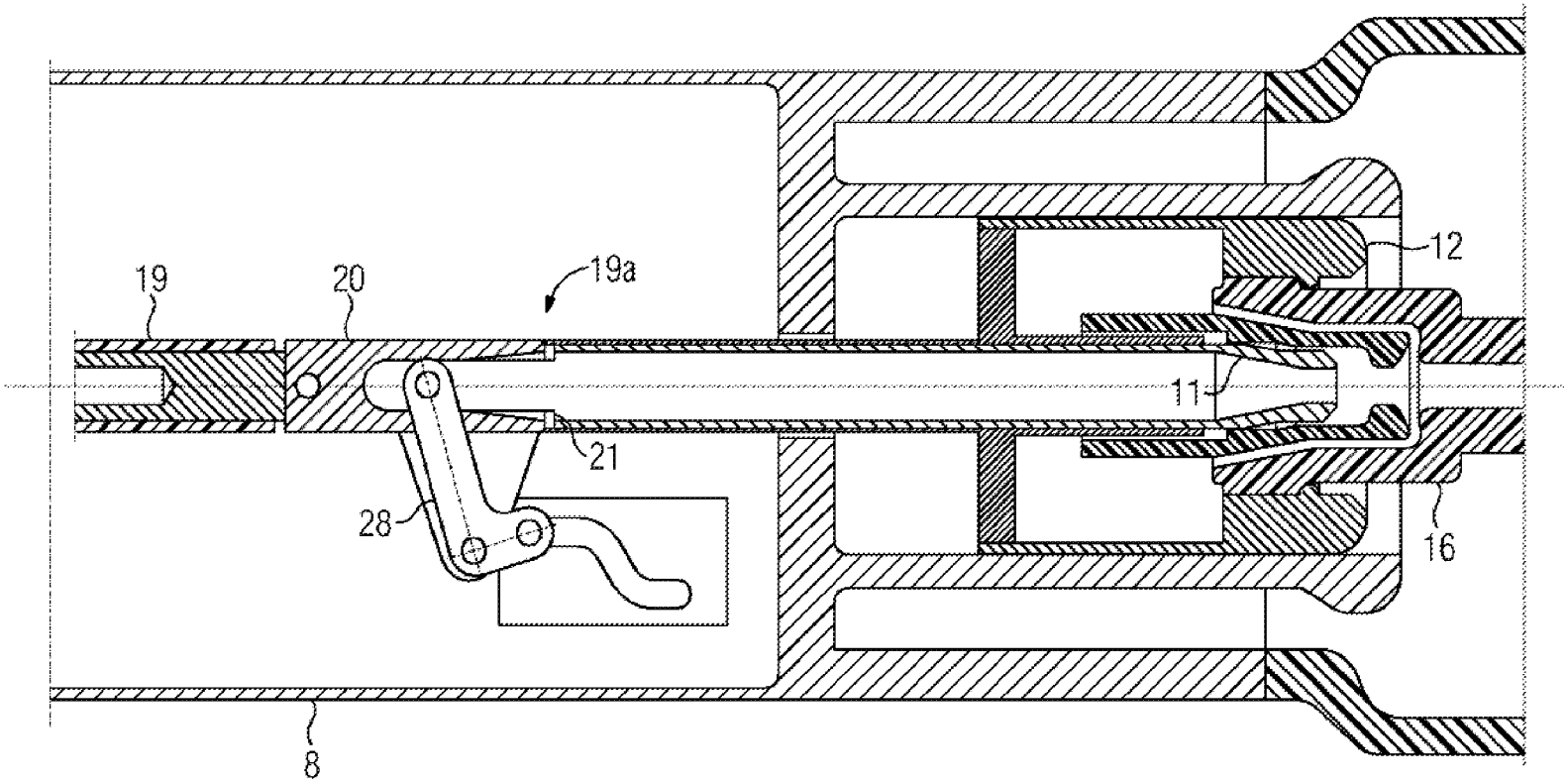
FIG. 8 shows a second variant embodiment of a first reduction gear.

FIG. 8 shows a second variant embodiment of a first reduction gear 19*a*.

The drive rod 19 is bolted directly to the first output-drive means 20. Thus, a movement of the drive rod 18 is transmitted directly onto the first output-drive means 20 and the first rated current contact piece 12 and the insulating nozzle 16. The drive rod 18, as drive means, therefore moves in the same way as the first output-drive means 20. A two-armed deflection lever 28 is mounted in rotationally movable fashion on the first output-drive means 20. A first lever arm of the deflection lever 28 is connected to the second output-drive means 21. The second output-drive means 21 has a slot, in which a pin of the first lever arm slides. Thus, an excess excursion of the first lever arm during pivoting can be compensated for. A second lever arm of the deflection lever 28 is provided with a sensing element, which engages in a slotted link, which is connected, fixed in position, to the first mounting element 8. The slotted link has, at the end, in each case one parallel profile with respect to the movement axis of the first arcing contact piece 11. A central region of the slotted link has a gradient with respect to the movement axis of the first arcing contact piece 11.

During a movement of the first output-drive means 20 (driven by drive rod 18), the deflection lever 28 mounted fixed in position thereon is moved along. The sensing element slides through the slotted link. During passing/sweeping of the end-side regions of the slotted link, a deflection force is applied to the deflection lever 28. As a result, the first arcing contact piece 11 and the first rated current contact piece 12 move in the same way. During these phases, the first arcing contact piece 11 and the first rated current contact piece 12 are at rest relative to one another.

During the sweeping of the central region of the slotted link, an additional accelerated movement is impressed on the second output-drive means 21 depending on the profile of the gradient of the slotted link. Correspondingly, the second output-drive means 21 is moved more quickly or more slowly relative to the first rated current contact piece 12. By virtue of the shape of the slotted link, the movement profile of the second output-drive means 21 can be varied. The second output-drive means 21 is connected to the first arcing contact piece 11. The first rated current contact piece 12 and the first arcing contact piece 11 are moved with movement profiles which differ from one another.

The invention claimed is:

1. A switching method for a switching device having a first contact side that is movable relative to a second contact side, the first contact side having a first rated current contact piece and a first arcing contact piece, and the second contact side having a second rated current contact piece and a second arcing contact piece, the switching method comprising the following steps:

in order to generate a relative movement between the first contact side and the second contact side, driving the first arcing contact piece and the first rated current contact piece and also the second arcing contact piece and the second rated current contact piece;

during a switching operation:

moving the first arcing contact piece according to a first movement profile and moving the first rated current contact piece with a second movement profile, wherein the first and second movement profiles of the first arcing contact piece and the first rated current contact piece are different from one another; and moving the second arcing contact piece with a given movement profile and moving a second rated current contact piece with a given movement profile, wherein the given movement profiles of the second arcing contact piece and the second rated current contact piece are different from one another.

2. The switching method according to claim 1, which comprises, in a switch-on operation, first moving the rated current contact pieces closer to one another while the arcing contact pieces remain in a field shadow of the respectively assigned rated current contact piece.

3. The switching method according to claim 2, which comprises moving the arcing contact pieces closer towards one another while remaining in the field shadow.

4. The switching method according to claim 1, which comprises, when a defined critical distance between the rated current contact pieces is reached, causing at least one of the arcing contact pieces to emerge from the field shadow of the respectively assigned rated current contact piece.

5. The switching method according to claim 4, which comprises causing both arcing contact pieces to emerge from the field shadow.

6. The switching method according to claim 1, which comprises, in a switch-off operation, first isolating the rated current contact pieces and then isolating the arcing contact pieces, and isolating the arcing contact pieces from one another at a relative speed which has approximately maximum during a switch-off operation.

7. The switching method according to claim 1, wherein, once a defined critical distance between the rated current contact pieces has been reached, at least one of the arcing contact pieces enters the field shadow of the respectively assigned rated current contact piece.

8. The switching method according to claim 7, wherein, when the defined critical distance between the rated current contact pieces has been reached, both of the arcing contact pieces enter the field shadow of the respectively assigned rated current contact piece.

9. The switching method according to claim 1, which comprises moving the first arcing contact piece relative to an insulating nozzle, which is connected to the first rated current contact piece, during a switching operation.

10. The switching method according to claim 9, wherein the insulating nozzle is connected to the first rated current contact piece in an angularly rigid relationship.

11. The switching method according to claim 9, which comprises moving the first arcing contact piece towards the insulating nozzle during a switch-on operation.

12. The switching method according to claim 9, which comprises removing the first arcing contact piece from the insulating nozzle during a switch-off operation.

13. A switching device, comprising:

a first contact side movably mounted relative to a second contact side;

said first contact side having a first rated current contact piece and a first arcing contact piece;

said second contact side having a second rated current contact piece and a second arcing contact piece;

wherein, in order to generate a relative movement between said first contact side and said second contact side, said first arcing contact piece, said first rated current contact piece, said second arcing contact piece and said second rated current contact piece are driven;

a first kinematic chain having a drive device, a first output-drive device and a second output-drive means;

said first output-drive device coupling in a first movement profile onto said first rated current contact piece;

said second output-drive device coupling in a different, second movement profile onto said first arcing contact piece;

a second kinematic chain having a drive device, a first output-drive device and a second output-drive device;

said first output-drive device of said second kinematic chain coupling in a first movement profile onto said second rated current contact piece; and said second output-drive device of said second kinematic chain coupling in a different, second movement profile onto said second arcing contact piece.

14. The switching device according to claim 13, wherein said first or second output-drive device of said first kinematic chain is connected to a drive device of said second kinematic chain.

15. The switching device according to claim 13, wherein said first or second output-drive device is connected to said second kinematic chain via an electrically insulating transmission element.

* * * * *